US008031132B2

(12) United States Patent
Liou et al.

(10) Patent No.: US 8,031,132 B2
(45) Date of Patent: Oct. 4, 2011

(54) DISPLAY DEVICE CAPABLE OF AUTOMATICALLY ADJUSTING DISPLAY ORIENTATION AND THE DISPLAY SEGMENT ARRANGEMENT THEREOF

(75) Inventors: Fou-Ming Liou, Taipei (TW); Yu-Liang Liu, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 835 days.

(21) Appl. No.: 11/892,345

(22) Filed: Aug. 22, 2007

(65) Prior Publication Data

US 2008/0048933 A1 Feb. 28, 2008

(30) Foreign Application Priority Data

Aug. 22, 2006 (TW) ..... 95130767 A

(51) Int. Cl.
*G09G 3/30* (2006.01)
*G09G 3/04* (2006.01)

(52) U.S. Cl. ..... 345/30; 345/33

(58) Field of Classification Search ..... 345/30, 345/33, 34, 659, 689, 649, 698; 368/223, 368/225

See application file for complete search history.

(56) References Cited

U.S. PATENT DOCUMENTS

| | | | | |
|---|---|---|---|---|
| 3,855,500 | A * | 12/1974 | Yanagisawa | 345/43 |
| 4,194,352 | A * | 3/1980 | Terzian | 345/33 |
| 5,189,408 | A * | 2/1993 | Teicher | 340/815.4 |
| 6,433,791 | B2 * | 8/2002 | Selli et al. | 345/659 |
| 6,727,868 | B2 * | 4/2004 | Matsui | 345/30 |
| 2003/0072168 | A1 * | 4/2003 | Hou et al. | 362/545 |

* cited by examiner

*Primary Examiner* — Kevin Nguyen
(74) *Attorney, Agent, or Firm* — Jianq Chyun IP Office

(57) ABSTRACT

The present invention provides a display device capable of automatically adjusting display orientation and the display segment arrangement thereof. The display device is provided for an electronic product. The display device includes: a segment display device, a position detection device and a decoding circuit. The segment display device has plural display segments arranged on the electronic device. The position detection device is arranged on the electronic product for generating a first status signal or a second status signal based on the electronic product being positioned horizontally or vertically. The decoding circuit connects to the segment display device and the position detection device for receiving a numerical signal and displaying the numerical signal on the segment display device based on the first status signal or second status signal.

18 Claims, 13 Drawing Sheets

DISPLAY DEVICE CAPABLE OF AUTOMATICALLY ADJUSTING DISPLAY ORIENTATION AND THE DISPLAY SEGMENT ARRANGEMENT THEREOF

BACKGROUND OF THE INVENTION

1. Field of the Invention

The present invention relates to a display device and, more particularly, to a display device capable of automatically adjusting display orientation and the display segment arrangement thereof.

2. Description of Related Art

Currently, the electronic product is provided with a display device for displaying some inner information such as the operation channel of the tuner and the operation frequency of the personal computer processor. Referring to the FIG. 1, a tuner 11 connects to a television monitor 12 for selecting program channel, and the tuner 11 has a display device such as the segment display for displaying channel numbers of present program.

Generally speaking, the display orientation of the display device 111 is horizontal because the tuner is positioned horizontally. However, please refer to FIG. 2, user may position the tuner 11 vertically for saving space occupation, therefore, the information displayed by the display device 111 will show reversely, which is very inconvenient for the user.

For preventing the aforementioned problems, the conventional tuner 11 may include two segment display devices for displaying channel numbers corresponding to the horizontal position or vertical position of the tuner 11 respectively. But, the aforementioned method may increase the cost due to the additional segment display device. In addition, the conventional electronic product also can use the LCD display to display the channel numbers; because the LCD display use the pixels to display information, the channel numbers will be displayed correctly in any orientation whether the tuner is positioned vertically or horizontally. However, the price of the LCD display is higher than segment display device, and the LCD display also needs more complexity driving circuit to perform displaying during operation period so as to increase the cost of the electronic product. Therefore, it is desired for the aforementioned conventional display device to be improved.

SUMMARY OF THE INVENTION

It is therefore the main object of the present invention to provide a display device capable of automatically adjusting display orientation and the segment arrangement thereof, which enables the display device to display inner information of electronic product in any orientation correctly whatever the display device is positioned in any orientation such as horizontal or vertical.

According to a first aspect of the present invention, this present invention provides a display device for use in an electronic product, comprising: a segment display device positioned on the electronic device, the segment display device including a plurality of display segments; a position detection device positioned on the electronic product for generating a first status signal or a second status signal according to a position status of the electronic product; and a decoding circuit connected to the segment display device and the position detection device for receiving a numerical signal to be displayed on the segment display device according to the first status signal and the second status signal.

According to a second aspect of the present invention, this present invention provides a display segment arrangement, comprising: a first display segment; a second display segment, wherein the first display segment and the second display segment are positioned vertically and aligned to each other; a third display segment; a fourth display segment, wherein the third display segment and the fourth display segment are positioned horizontally and aligned to each other; a first quadrilateral display segment set neighbored with the first display segment and the third display segment; a second quadrilateral display segment set neighbored with the second display segment and the first quadrilateral display segment set; and a third quadrilateral display segment set neighbored on the fourth display segment and the first quadrilateral display segment set; wherein each of the first quadrilateral display segment set, the second quadrilateral display segment set, and the third quadrilateral display segment set is composed of four display segments.

According to a third aspect of the present invention, A display segment arrangement, comprising: a first quadrilateral display segment set; a second quadrilateral display segment set neighbored with the first quadrilateral display segment set; a third quadrilateral display segment set neighbored with the first quadrilateral display segment set; and a fourth quadrilateral display segment set neighbored with the second quadrilateral display segment set and the third quadrilateral display segment set; wherein each of the first quadrilateral display segment set, the second quadrilateral display segment set, the third, quadrilateral display segment set, and the fourth quadrilateral display segment set is composed of four display segments.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
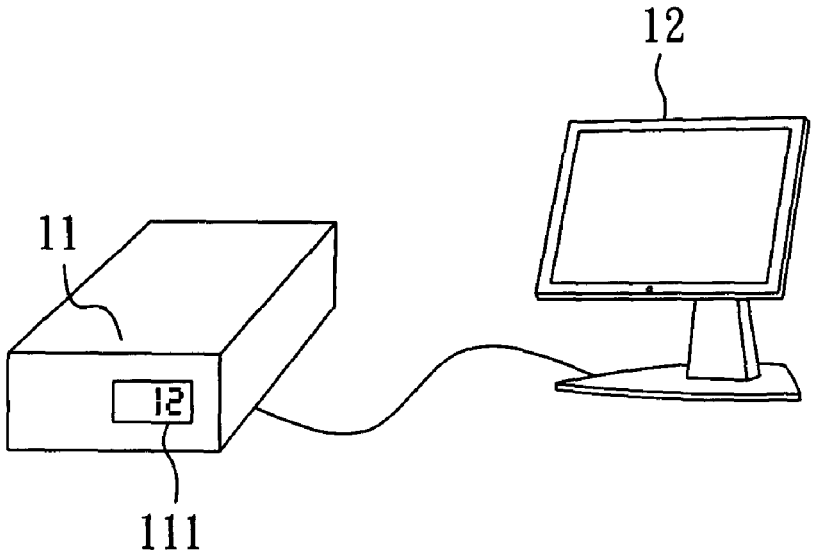
FIG. 1 (PRIOR ART)
FIG. 1 shows a schematic diagram of the prior art in which the tuner is positioned horizontally.
Figure 2:
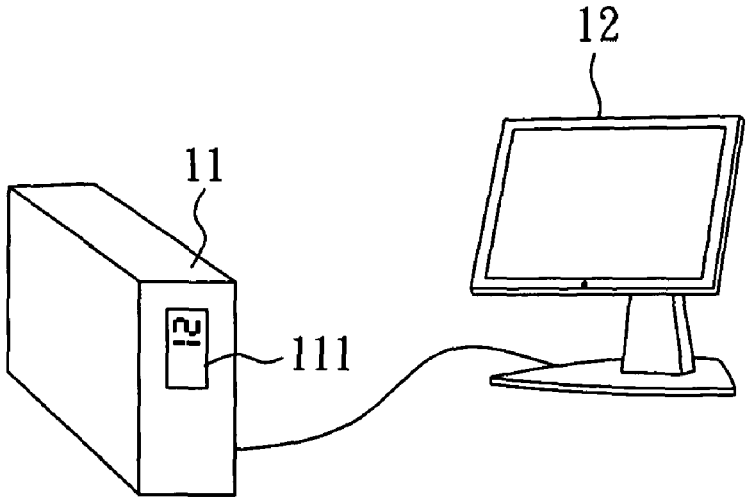
FIG. 2 (PRIOR ART)
FIG. 2 shows a schematic diagram of the prior art in which the tuner is positioned vertically.
Figure 3A:
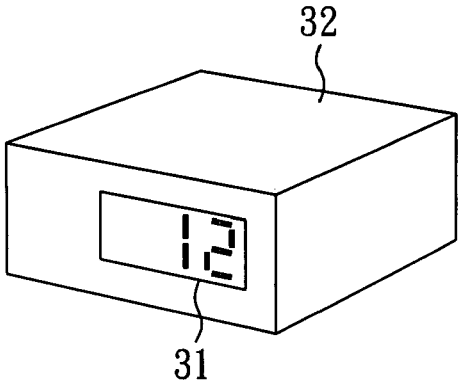
FIG. 3A and FIG. 3B illustrate a schematic diagram showing an embodiment of a display device capable of automatically adjusting display orientation according to the present invention respectively.
Figure 3B:
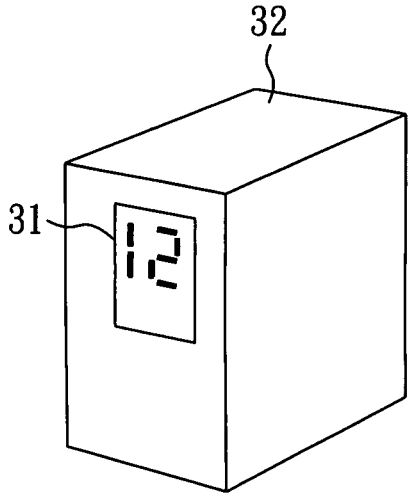

FIG. 3A is a schematic diagram showing an embodiment of a display device 31 capable of automatically adjusting display orientation according to the present invention, wherein the display device 31 is positioned horizontally. FIG. 3B is a schematic diagram showing an embodiment of a display device 31 capable of automatically adjusting display orientation according to the present invention, wherein the display device 31 is positioned vertically. In this embodiment, the display device 31 always can display the inner information of the electronic product 32 correctly whatever the electronic product 32 is positioned horizontally or vertically.

Figure 4:
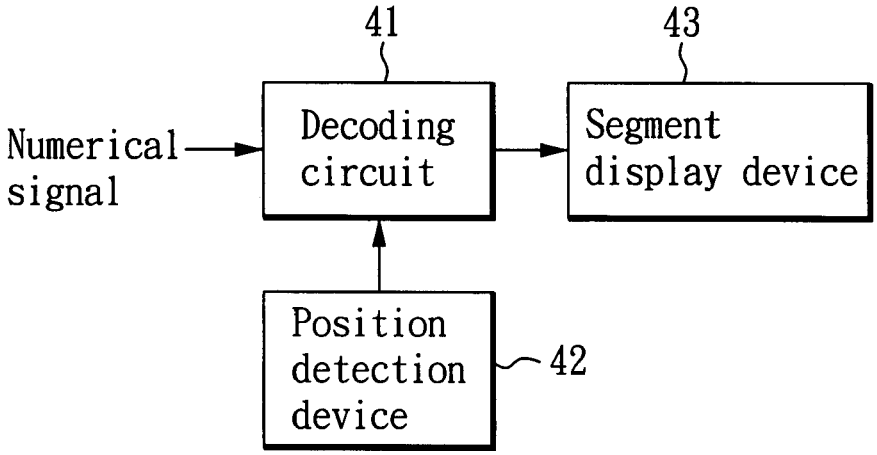
FIG. 4 shows a functional diagram of display device of the present invention.

FIG. 4 shows a functional diagram of display device 31 of the present invention. In this embodiment, the display device 31 comprises a decoding circuit 41, a position detection device 42 and a segment display device 43. The position detection device 42 can detect the position status of the electronic product such as the horizontal position or vertical position. The position detection device is preferably a rolling switch, a mercury switch, or a tilt switch. While the electronic product is positioned horizontally or vertically, the switch will be in different status. For example, while the electronic product 32 is positioned horizontally, the switch will be in off status; while the electronic product 32 is positioned vertically, the switch will be in on status. Therefore, the position detection device 42 can generate a first status signal or a second status signal respectively according to the position status of the electronic product 32.

The decoding circuit connects to the segment display device 43 and the position detection device 41, and the decoding circuit 41 is preferably a decoding logic composed of the digital logic elements or a processor executing a decoding software for receiving a numerical signal transmitted by the inner circuit of the electronic product 32 so as to generate the first status signal or the second status signal for displaying the numerical signal on the segment display device 43.

Figure 5:
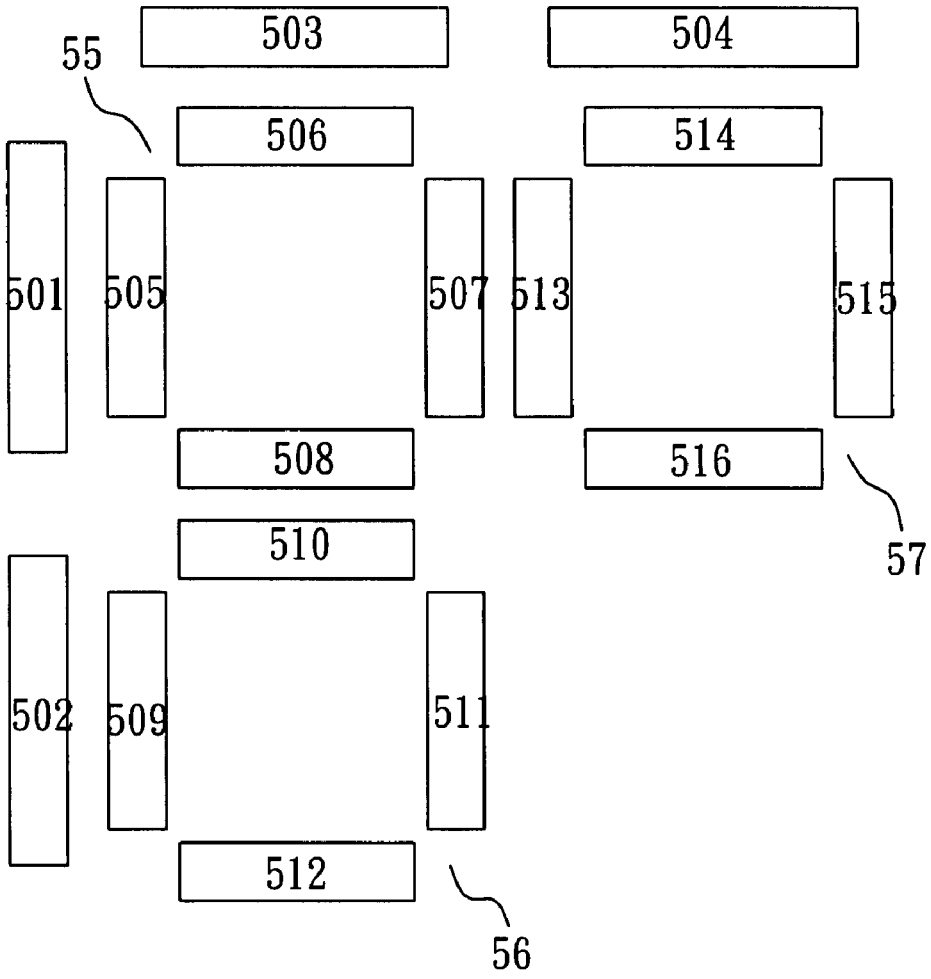
FIG. 5 is a schematic view of a first preferred embodiment according to the segment display device of the present invention.

FIG. 5 is a schematic view of a preferred embodiment according to the segment display device 43 of the present invention. In this embodiment, the segment display device 43 is arranged by a plurality of the display segments 501-516, and each of the display segments 501-516 is preferably a segment LED or a Vacuum Fluorescent Display. The display device 43 can selectively turn on some display segments for displaying the numbers according to the decoding result of the numerical signal. The arrangement structure of the display segments 501-506 is such that: the first display segment 501 and the second display segment 502 are positioned vertically and aligned to each other; the third display segment 503 and the fourth display segment 504 are positioned horizontally and aligned to each other; a first quadrilateral display segment set 55 is composed of the fifth, the sixth, the seventh, and the eighth display segments 505-508; a second quadrilateral display segment set 56 is composed of the ninth, the tenth, the eleventh, and the twelfth display segments 509-512; a third quadrilateral display segment set 57 is composed of the thirteenth, the fourteenth, the fifteenth, and the sixteenth display segments 513-516.

The first quadrilateral display segment set 55 neighbors with the first display segment 501, the third display segment 503, the second quadrilateral display segment set 56, and the third quadrilateral display segment set 57; the second quadrilateral display segment set 56 neighbors with the second display segment 502 and the first quadrilateral display segment set 55; the third quadrilateral display segment set 57 neighbors with the fourth display segment 504 and the first quadrilateral display segment set 55.

The first quadrilateral display segment set 55 is composed of the fifth, the sixth, the seventh, and the eighth display segments 505-508, wherein the fifth display segment 505 neighbors with the first display segment 501, and other display segments 506-508 arrange as a quadrilateral in clockwise; the second quadrilateral display segment set 56 is composed of the ninth, the tenth, the eleventh, and the twelfth display segments 509-512, wherein the ninth display segment 509 neighbors with the second display segment 502, and other display segments 510-512 arrange as a quadrilateral in clockwise; the third quadrilateral display segment set 57 is composed of the thirteenth, the fourteenth, the fifteenth, and the sixteenth display segments 513-516, wherein the thirteenth display segment 513 neighbors with the first quadrilateral display segment set 55, and other display segments 514-516 arrange as a quadrilateral in clockwise.

Figure 6:
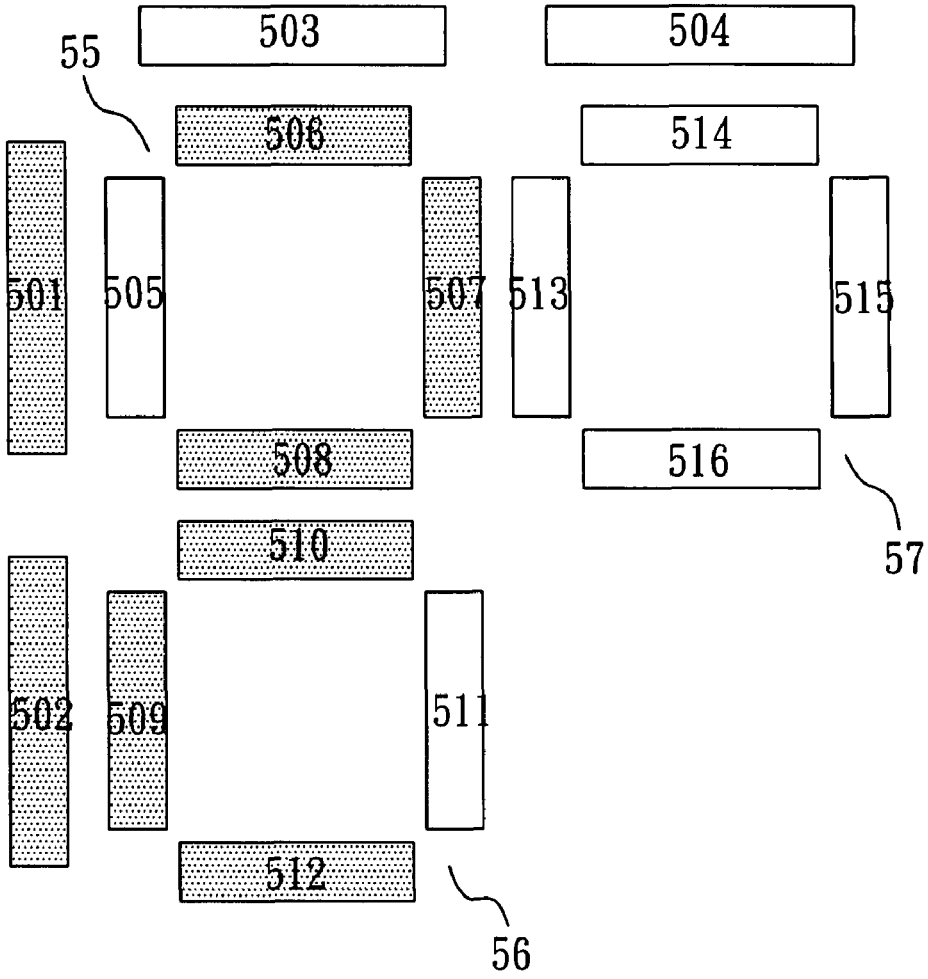
FIG. 6 is a first display example of the first preferred embodiment according to the segment display device of the present invention.

According to the aforementioned arrangement of the display segments 501-516, while the electronic product 32 is positioned horizontally, the first display segment 501 and the second display segment 502 are used to display the number "1" in the tenth place, and the first quadrilateral display segment set 55 and the second quadrilateral display segment set 56 are used to display the number "0" to "9" in the unit place. Therefore, the segment display 43 can display the number from "0" to "19". Please refer to FIG. 6, the display segments 501-516 display the number "12", wherein the first display segment 501 and the second display segment 502 display the number "1" in the tens place, and the display segments 506, 507, 508 of the first quadrilateral display segment set 55 and the display segments 509, 510, 512 of the second quadrilateral display segment set 56 display the number "2" in the unit place.

Figure 7:
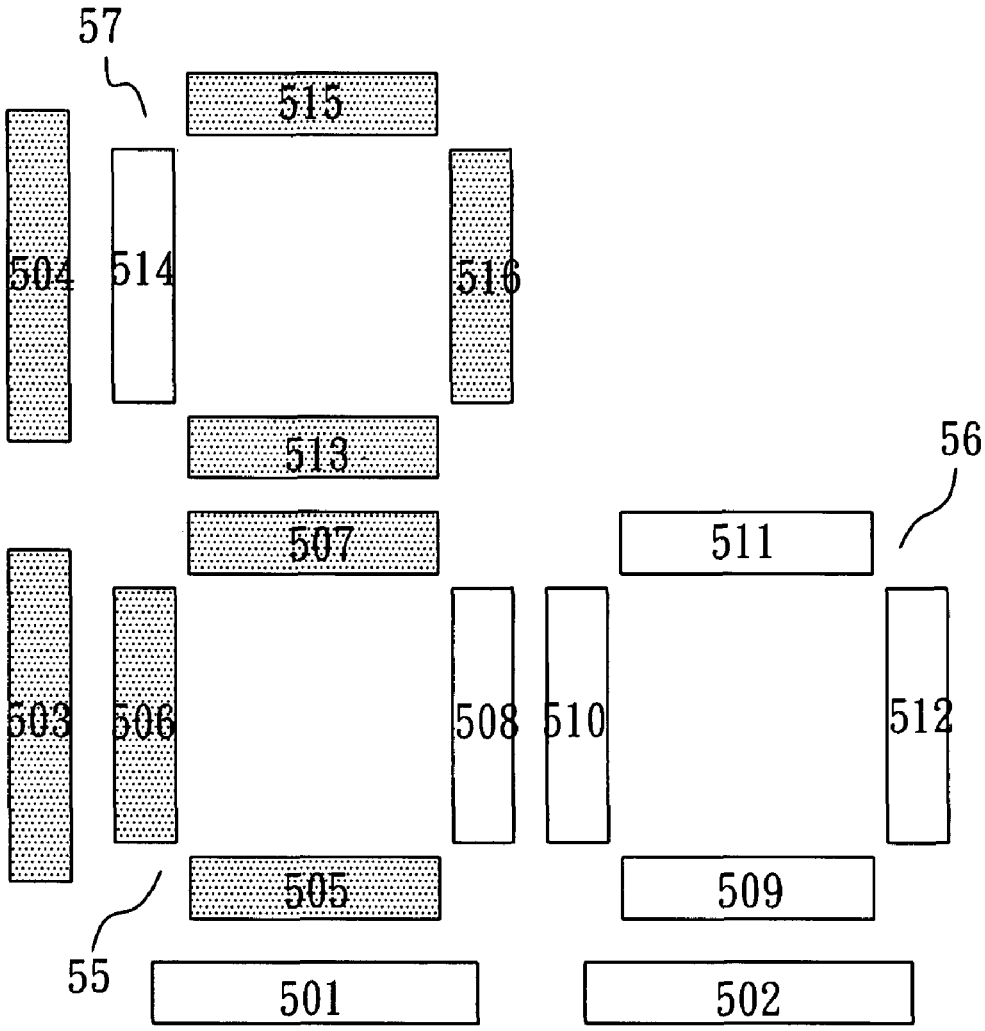
FIG. 7 is a second display example of the first preferred embodiment according to the segment display device of the present invention.

While the electronic product 32 is positioned horizontally such as 90-degree rotation in anticlockwise, the arrangement of the display segments 501-516 is shown as the FIG. 7. The third display segment 503 and the fourth display segment 504 can display the number "1" in the tens place, and the first quadrilateral display segment set 55 and the third quadrilateral display segment set 57 can display the number "0" to "9" in the unit place. Therefore, the segment display device 43 can display the number from "0" to "19". Referring to FIG. 7, the display segments 501-516 display the number "12", wherein the third display segment 503 and the fourth display segment 504 display the number "1" in the tens place, and the display segments 513, 515, 516 of the third quadrilateral display segment set 57 and the display segments 505, 506, 507 of the first quadrilateral display segment set 55 display the number "2" in the unit place.

Figure 8:
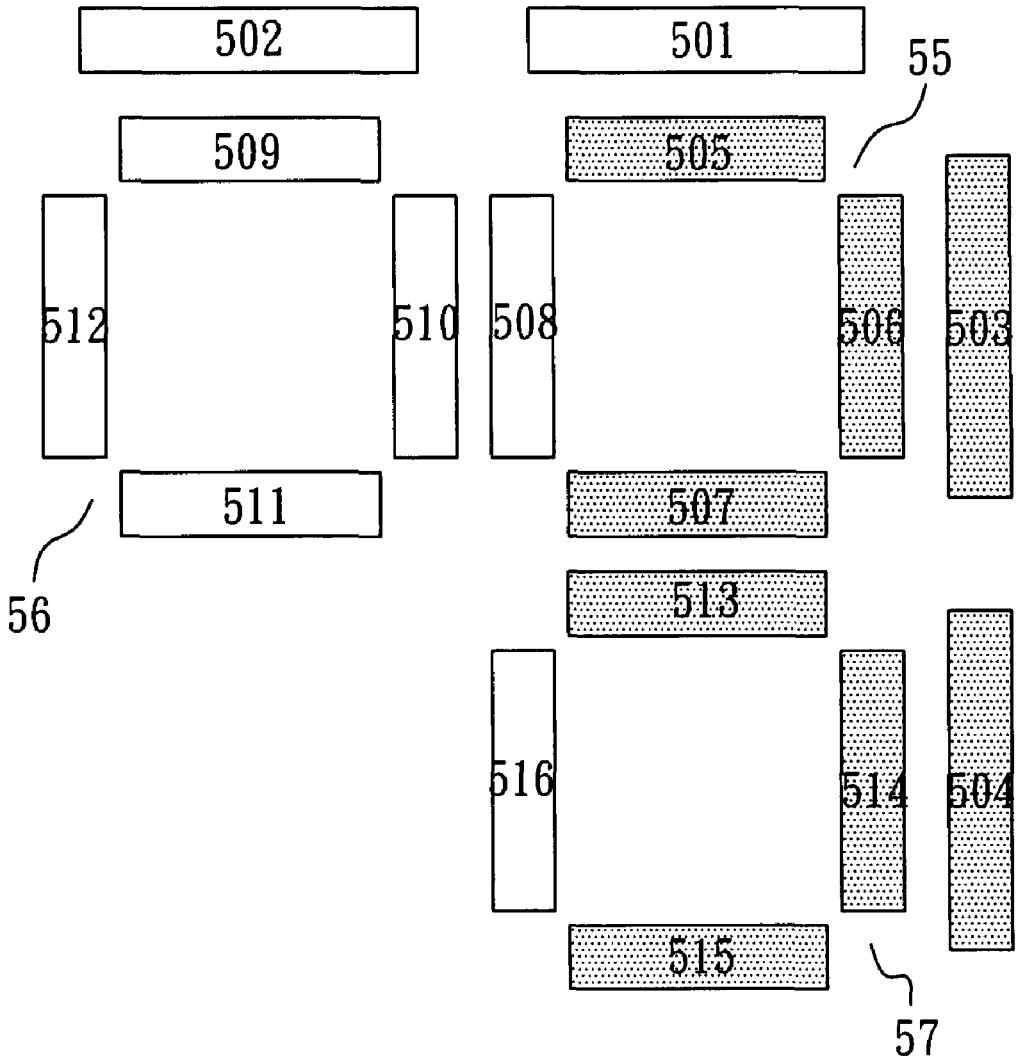
FIG. 8 is a third display example of the first preferred embodiment according to the segment display device of the present invention.

In another embodiment, please refer to FIG. 8, after a 90-degree rotation in clockwise, the electronic product 32 changes the deposition status from horizontal to vertical. The first quadrilateral display segment set 55 and the third quadrilateral display segment set 57 display the number "0" to "9" in the tens place, and the third display segment 503 and the fourth display segment 504 display the number "1" in the unit place. Therefore, the segment display device 43 can display the number as "01", "11", "21", . . . , and "91". Please refer to FIG. 8, the display segments 505, 506, 507 of the first quadrilateral display segment set 55 and the display segments 513, 514, 515 of the first quadrilateral display segment set 57 can display the number "3" in ten tens place, and the third display segment 503 and the fourth display segment 504 can display the number "1" in the unit place.

Figure 9:
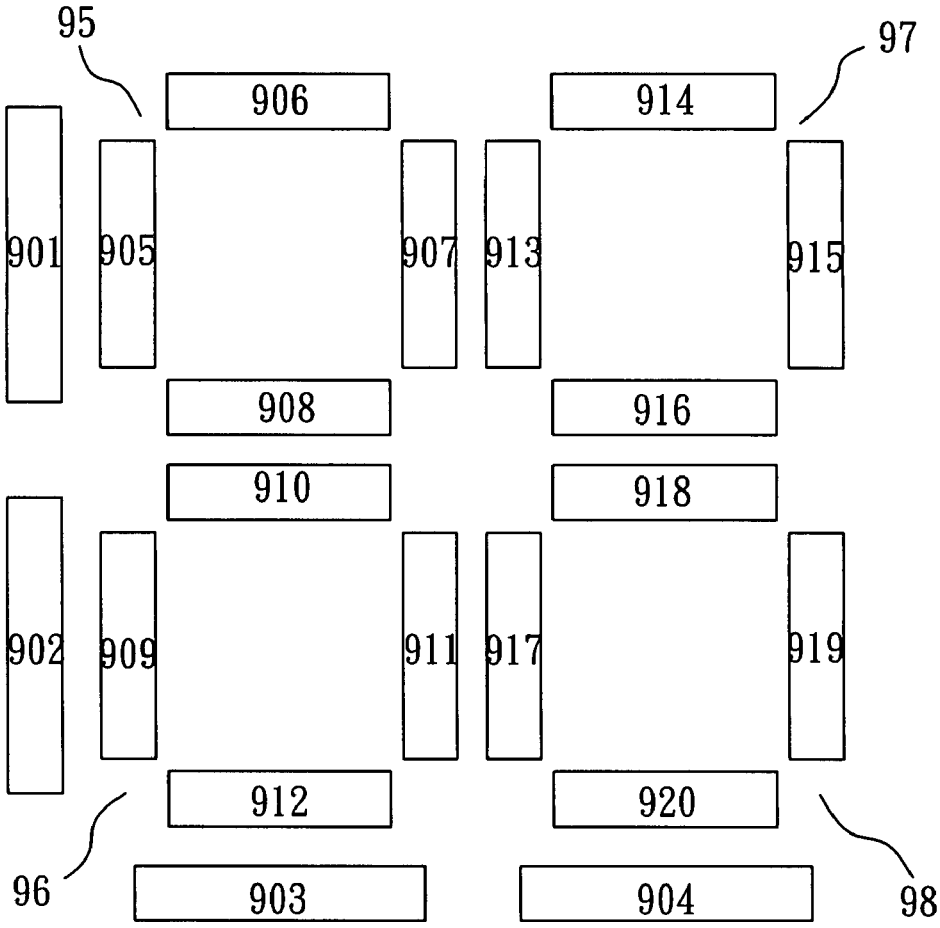
FIG. 9 is a schematic view of a second preferred embodiment according to the segment display device of the present invention.

FIG. 9 is a schematic view of a second preferred embodiment according to the segment display device 43 of the present invention. The display device 43 comprises a plurality of display segments 901-920. The arrangement structure of the display segments 901-920 is such that: the first display segment 901 and the second display segment 902 are positioned vertically and aligned to each other; the third display segment 903 and the fourth display segment 904 are positioned horizontally and aligned to each other; a first quadrilateral display segment set 95 is composed of the fifth, the sixth, the seventh, and the eighth display segments 905-908; a second quadrilateral display segment set 96 is composed of the ninth, the tenth, the eleventh, and the twelfth display segments 909-912; a third quadrilateral display segment set 97 is composed of the thirteenth, the fourteenth, the fifteenth, and the sixteenth display segments 913-916; a fourth quadrilateral display segment set 98 is composed of the seventeenth, the eighteenth, the nineteenth, and the twentieth display segments 917-920.

The first quadrilateral display segment set 95 neighbors with the first display segment 901, the second quadrilateral display segment set 96, and the third quadrilateral display segment set 97; the second quadrilateral display segment set 96 neighbors with the second display segment 902, the third display segment 903, the first quadrilateral display segment set 95 and the fourth quadrilateral display segment 98; the third quadrilateral display segment set 97 neighbors with the first quadrilateral display segment set 95 and the fourth quadrilateral display segment 98; the fourth quadrilateral display segment set 98 neighbors with the second quadrilateral display segment set 96, the third quadrilateral display segment set 97 and the fourth display segment 904.

The first quadrilateral display segment set 95 is composed of the fifth, the sixth, the seventh, and the eighth display segments 905-908, wherein the fifth display segment 905 neighbors with the first display segment 901, and other display segments 906-908 arrange as a quadrilateral in clockwise; the second quadrilateral display segment set 96 is composed of the ninth, the tenth, the eleventh, and the twelfth display segments 909-912, wherein the ninth display segment 909 neighbors with the second display segment 902, and other display segments 910-912 arrange as a quadrilateral in clockwise; the third quadrilateral display segment set 97 is composed of the thirteenth, the fourteenth, the fifteenth, and the sixteenth display segments 913-916, wherein the thirteenth display segment 913 neighbors with the first quadrilateral display segment set 95, and other display segments 914-916 arrange as a quadrilateral in clockwise; the fourth quadrilateral display segment set 98 is composed of the seventeenth, the eighteenth, the nineteenth, and the twentieth display segments 917-920, wherein the seventeenth display segment 917 neighbors with the first quadrilateral display segment set 96, and other display segments 918-920 arrange as a quadrilateral in clockwise It is noted that, the display segment arrangement comprises the first quadrilateral display segment set 95, the second quadrilateral display segment set 96 neighbored with the first quadrilateral display segment set 95, the third quadrilateral display segment 97 neighbored with the first quadrilateral display segment set 95, and the fourth quadrilateral display segment set 98 neighbored with the second quadrilateral display segment set 96 and the third quadrilateral display segment set 97. With such a structure, it is able to automatically adjust display orientation. For displaying more numbers, the display segment arrangement may further comprise a first display segment 901 neighbored with the first quadrilateral display segment set 95; and a second display segment 902 neighbored with the second quadrilateral display segment set 96, wherein the first display segment 901 and the second display segment 902 are positioned vertically and aligned to each other; a third display segment 903 neighbored with the second quadrilateral display segment set 96; and a fourth display segment 904 neighbored with the fourth quadrilateral display segment set 98, wherein the third display segment 903 and the fourth display segment 904 are positioned horizontally and aligned to each other.

Figure 10:
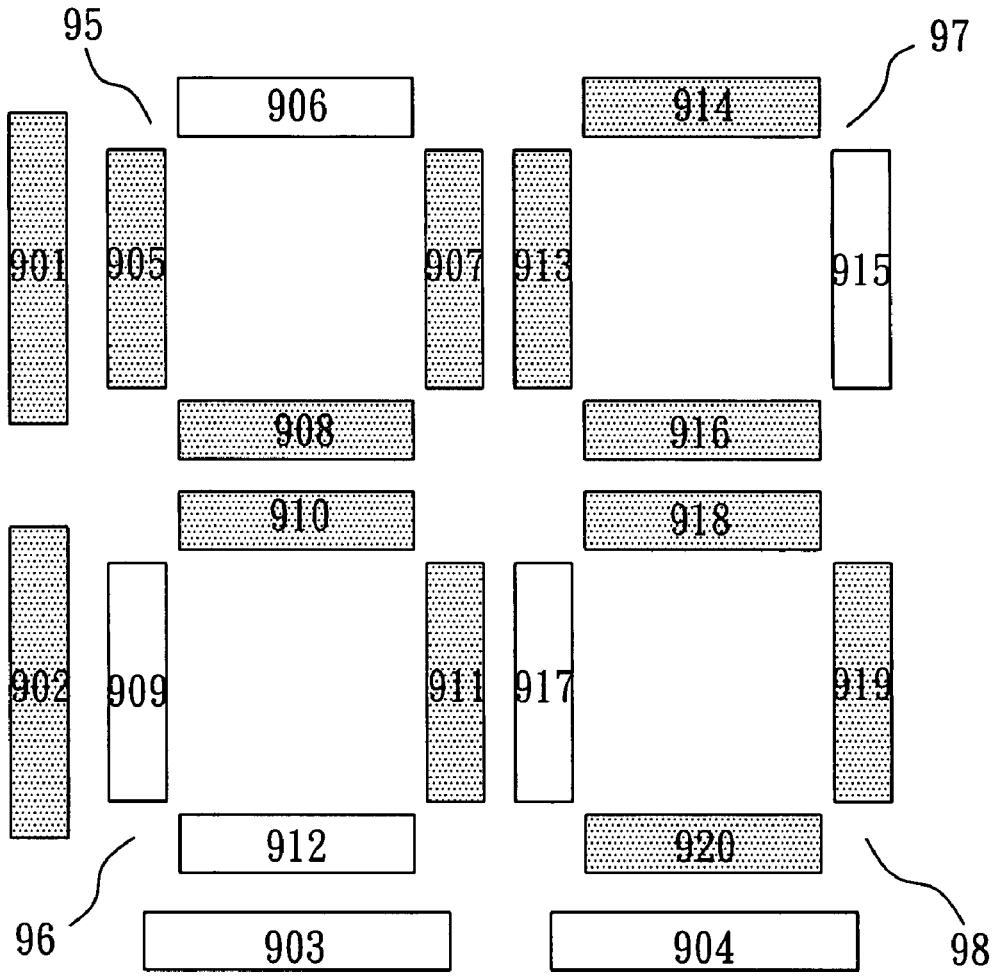
FIG. 10 is a first display example of the second preferred embodiment according to the segment display device of the present invention.

According to the aforementioned arrangement of the display segments 501-516, while the electronic product 32 is positioned horizontally, the first display segment 901 and the second display segment 902 are used to display the number "1" in the hundreds place, and the first quadrilateral display segment set 95 and the second quadrilateral display segment set 96 are used to display the number "0" to "9" in the tens place, and the third quadrilateral display segment set 97 and the fourth quadrilateral display segment set 98 use to display the number "0" to "9" in the unit place. Therefore, the segment display 43 can display the number "0" to "199". Please refer to FIG. 10, the display segments 901-920 display the number 145, wherein the first display segment 901 and the second display segment 902 display the number "1" in the hundreds place, and the display segments 906, 907, 908 of the first quadrilateral display segment set 95 and the display segments 909, 910, 912 of the second quadrilateral display segment set 96 display the numeric "4" in the tens place, and the display segments 913, 914, 916 of the third quadrilateral display segment set 97 and the display segments 918, 919, 920 of the fourth quadrilateral display segment set 98 display the number "5" in the unit place.

Figure 11:
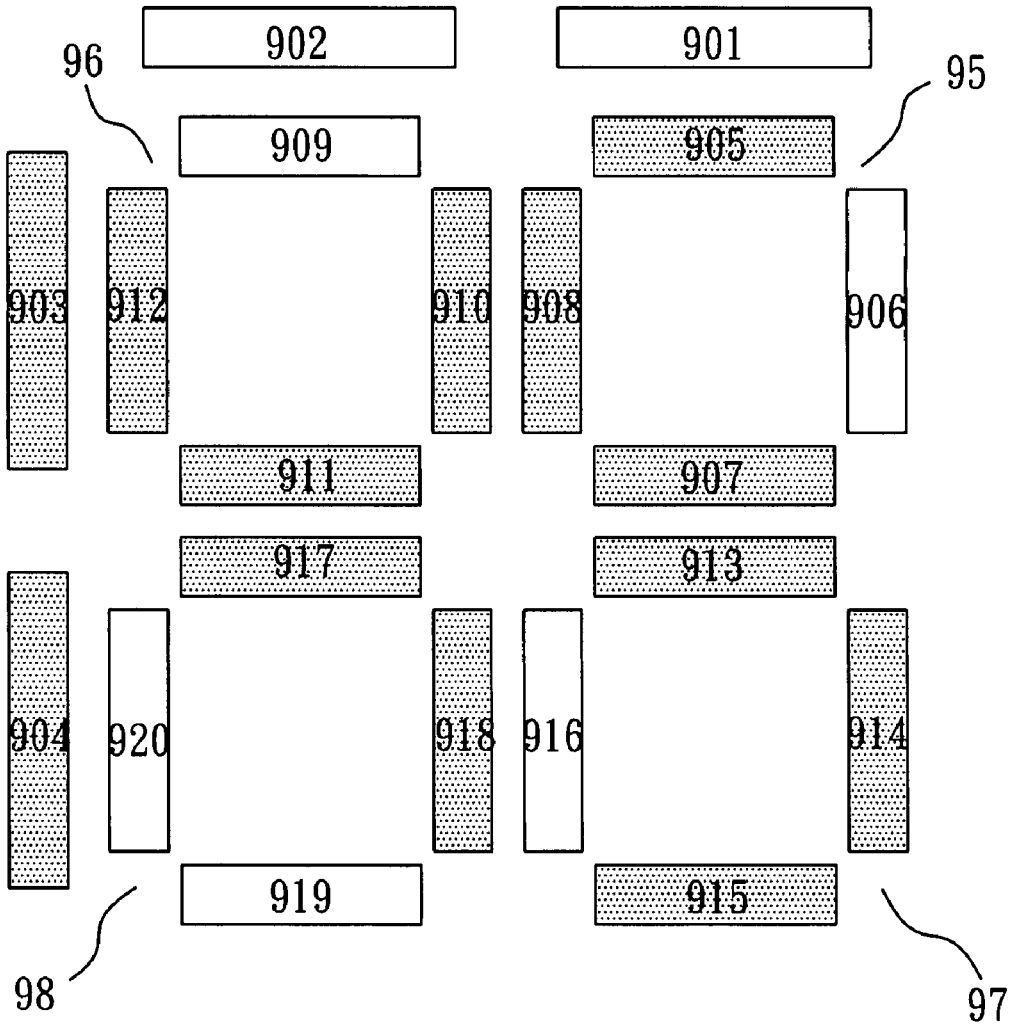
FIG. 11 is a second display example of the second preferred embodiment according to the segment display device of the present invention.

While the electronic product 32 is positioned horizontally such as 90-degree rotation in anticlockwise, the arrangement of the display segments 901-920 is shown as the FIG. 7. The third display segment 903 and the fourth display segment 904 can display the number "1" in the hundreds place, and the second quadrilateral display segment set 96 and the fourth quadrilateral display segment 98 can display the number "0" to "9" in the tens place, and the first quadrilateral display segment set 95 and the third quadrilateral display segment set 97 can display the number "0" to "9" in the unit place. Therefore, the segment display device 43 can display the number from "0" to "199". Referring to FIG. 11, the display segment 901-920 display the number "145", wherein the third display segment 903 and the fourth display segment 904 display the number "1" in the hundreds place, and the display segments 910, 911, 912 of the second quadrilateral display segment set 96 and the display segments 917, 918 of the fourth quadrilateral display segment set 98 display the number 4 in the tens place, and the display segments 905, 906, 907 of the first quadrilateral display segment set 95 and the display segments 913, 914, 915 of the third quadrilateral display segment set 97 display the number "5" in the unit place.

Figure 12:
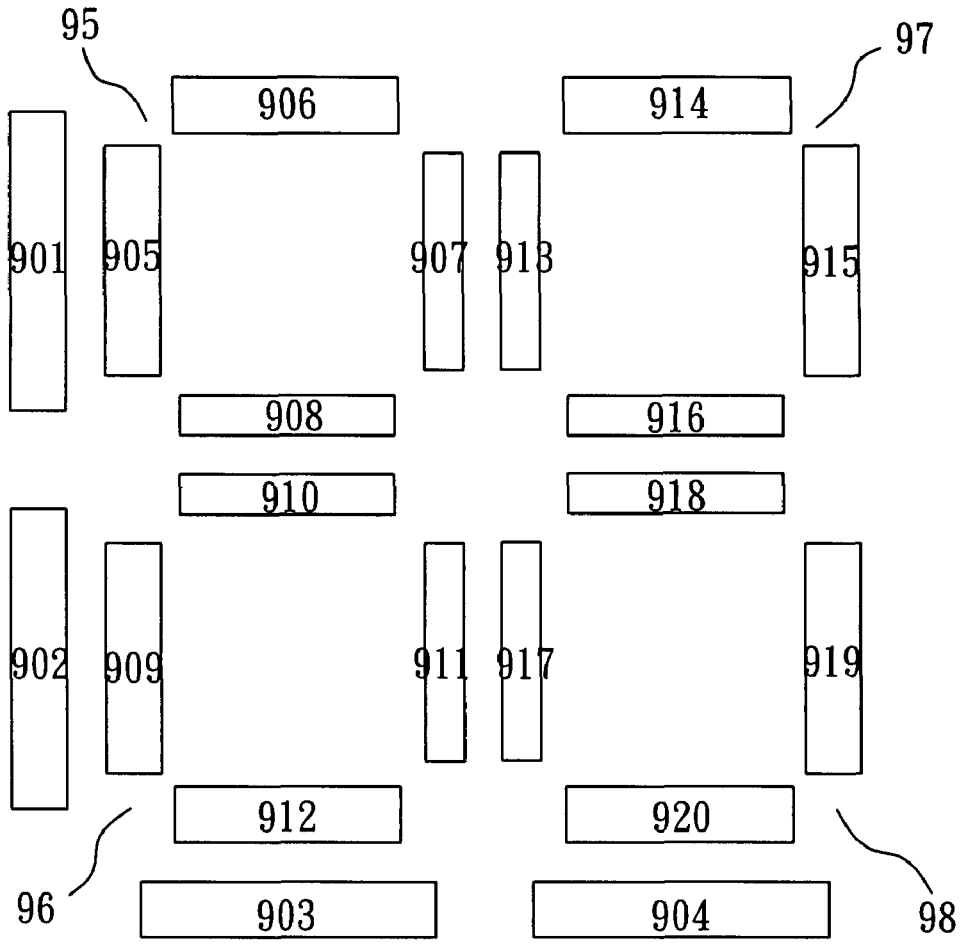
FIG. 12 is a schematic view of a third preferred embodiment according to the segment display device of the present invention.

FIG. 12 is a schematic view of a third preferred embodiment according to the segment display device 43 of the present invention. The arrangement of the display segments 901-920 is substantially similar to the second embodiment. The difference between the third embodiment and the second embodiment is the width of the display segment. In this embodiment, the width of the seventh display segment 907, the eighth display segment 908, the tenth display segment 910, the eleventh display segment 911, the thirteenth display segment 913, the sixteenth display segment 916, the seventeenth display segment 917 or the eighteenth display segment 918 is a half of the other display segments. Therefore, the numbers displayed on the segment display device 43 is more beautiful due to the aforementioned structure.

Figure 13:
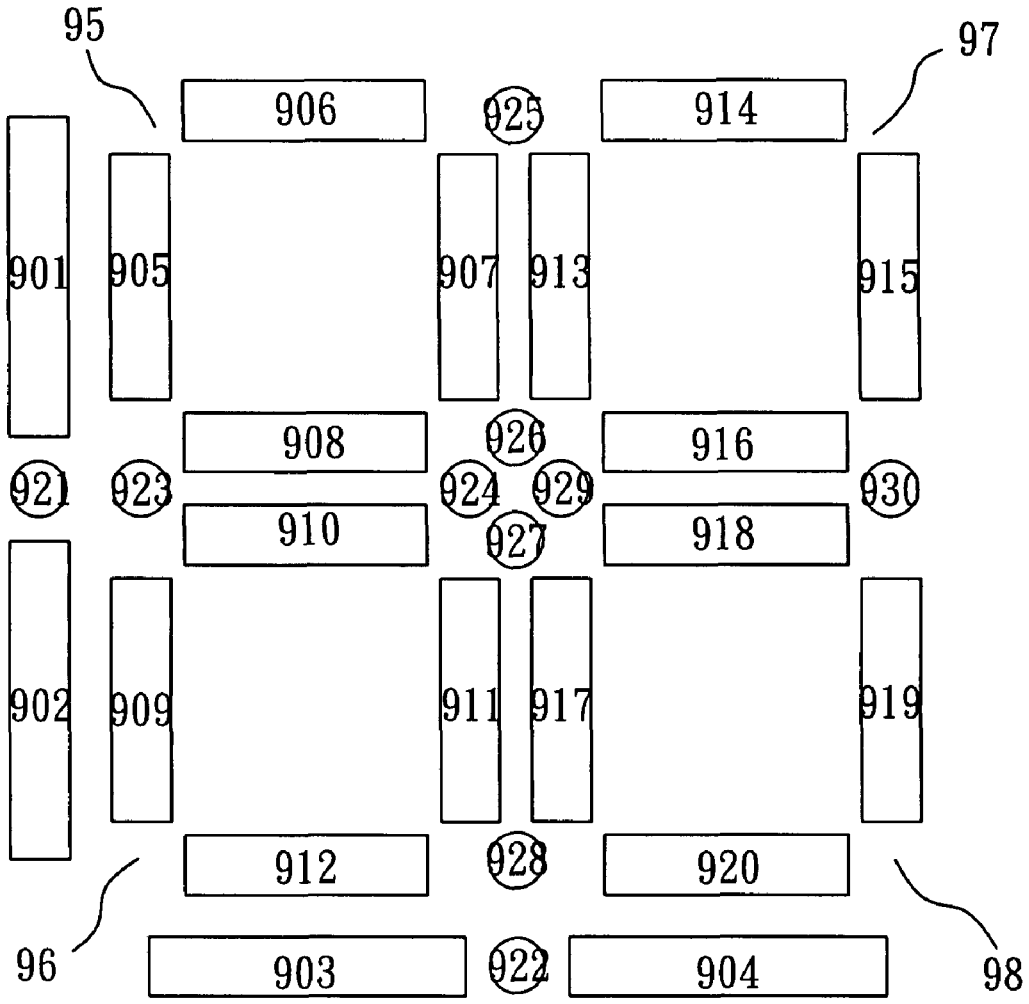
FIG. 13 is a schematic view of a fourth preferred embodiment according to the segment display device of the present invention.

FIG. 13 is a schematic view of a fourth preferred embodiment according to the segment display device 43 of the present invention. The arrangement of the display segments 901-920 is substantially similar to the second embodiment, except that, in this embodiment, the display segment arrangement further comprises a first circle display segment 921 located between the first display segment 901 and the second display segment 902; a second circle display segment 922 located between the third display segment 903 and the fourth display segment 904; a third circle display segment 923 located between the fifth display segment 905 and the ninth display segment 909; a fourth circle display segment 924 located between the seventh display segment 907 and the eleventh display segment 911; a fifth circle display segment 925 located between the sixth display segment 906 and the fourteenth display segment 914; a sixth circle display segment 926 located between the eighth display segment 908 and the sixteenth display segment 916; a seventh circle display segment 927 located between the tenth display segment 910 and the eighteenth display segment 918; a eighth circle display segment 928 located between the twelfth display segment 912 and the twentieth display segment 920; a ninth circle display segment 929 located between the thirteenth display segment 913 and the seventeenth display segment 917; a tenth circle display segment 930 located between the fifteenth display segment 915 and the nineteenth display segment 919.

Figure 14:
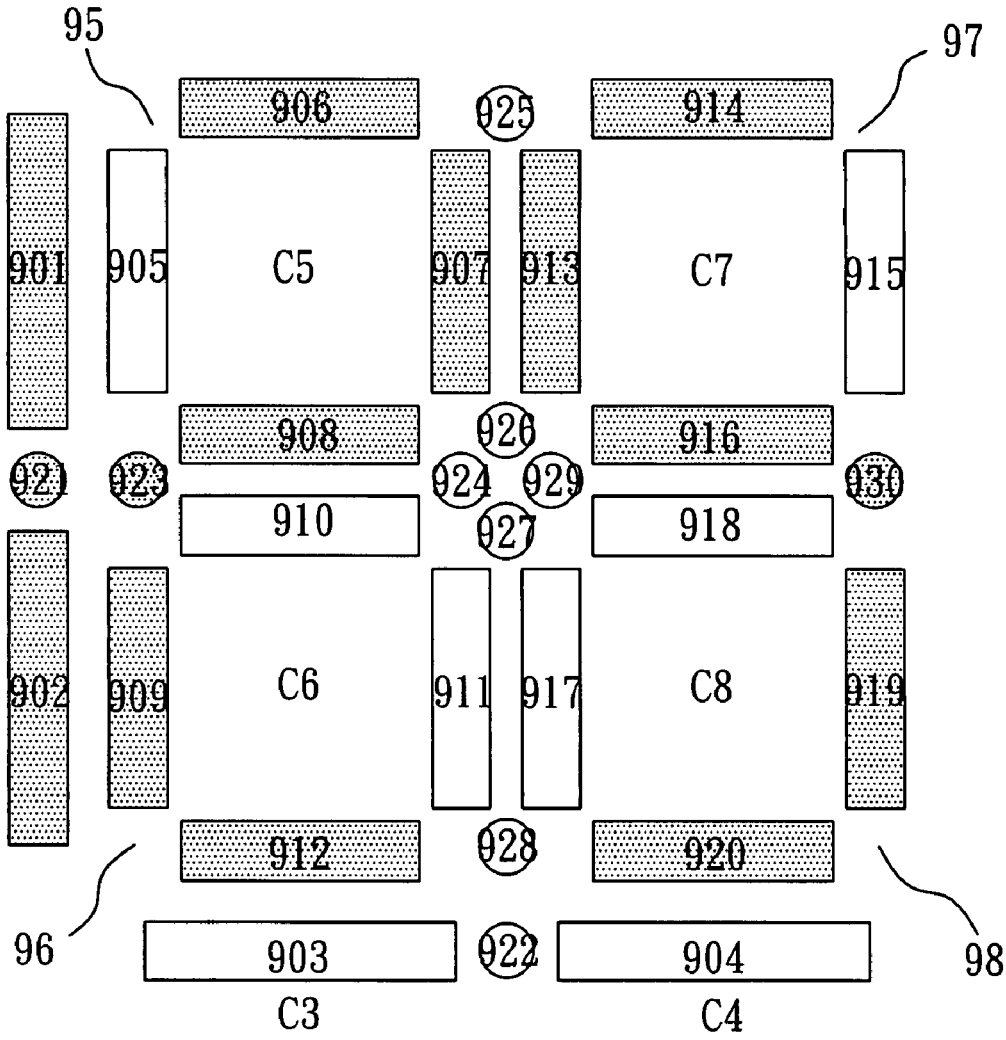
FIG. 14 is a first display example of the fourth preferred embodiment according to the segment display device of the present invention.

According to the aforementioned arrangement of the display segments 901-920, while the electronic product 32 is positioned horizontally, the first display segment 901, the second display segment 902, and the first circle display segment 921 are used to display the number "1" in the hundreds place, and the first quadrilateral display segment set 95, the second quadrilateral display segment set 96, the third circle display segment 923, and the fourth circle display segment 924 are used to display the number "0" to "9" in the tens place, and the third quadrilateral display segment set 97, the fourth quadrilateral display segment set 98, the ninth circle display segment 929, and the tenth display segment 930 are used to display the number "0" to "9" in the unit place. Therefore, the segment display 43 can display the number "0" to "199". Please refer to FIG. 14, the display segments 901-920 and the circle display segments 921-930 display the number "125", wherein the first display segment 901, the second display segment 902, and the first circle display segment 921 are used to display the number "1" in the hundreds place, and the display segments 906, 907, 908 of the first quadrilateral display segment set 95, the third circle display segment 923, and the display segments 909, 912 of the second quadrilateral display segment set 96 are used to display the number "2" in the tens place, and the display segments 913, 914, 916 of the third quadrilateral display segment set 97, the tenth circle display segment 930, and the display segments 918, 919, 920 of the fourth quadrilateral display segment set 98 display the number "5" in the unit place. In this embodiment, the display device 43 further comprises the circle display segments 921-930 so as to display the numbers continuously.

Figure 15:
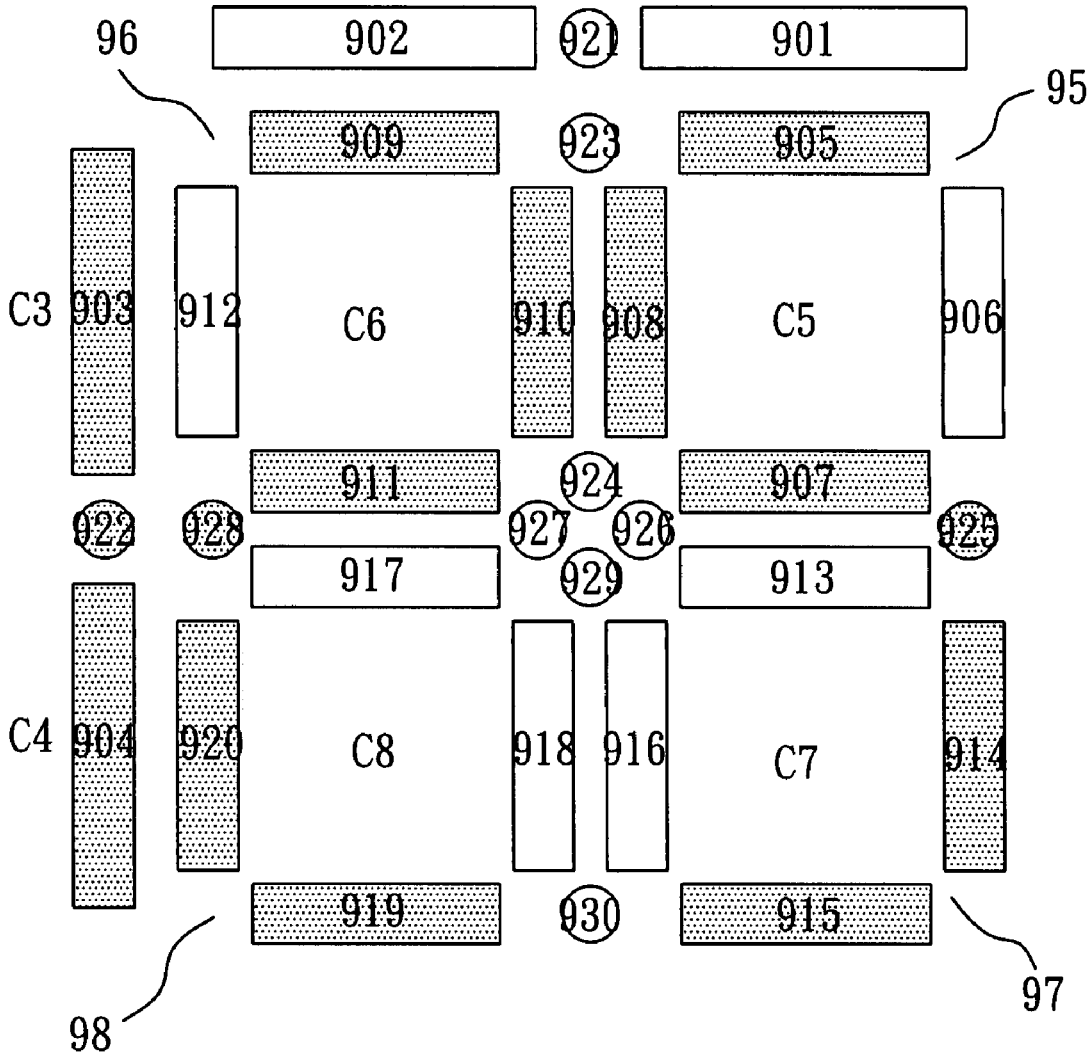
FIG. 15 is a second display example of the fourth preferred embodiment according to the segment display device of the present invention.

While the electronic product 32 is positioned vertically such as 90-degree rotation in anticlockwise, the arrangement of the display segments 901-920 and the circle display segments 921-930 is shown as the FIG. 7. The third display segment 903, the fourth display segment 904, and the second circle display segment 922 can display the number "1" in the hundreds place, and the second quadrilateral display segment set 96, the fourth quadrilateral display segment 98, the seventh circle display segment 927 and the eighth circle display segment 928 can display the number "0" to "9" in the tens place, and the first quadrilateral display segment set 95, the third quadrilateral display segment set 97, the fifth circle display segment 925 and the sixth circle display segment 926 can display the number "0" to "9" in the unit place. Therefore, the segment display device 43 can display the number from "0" to "199". Referring to FIG. 15, the display segments 901-920 display the number 125, wherein the third display segment 903, the fourth display segment 904, and the second circle display segment 922 are used to display the number "1" in the hundreds place, and the display segments 909, 910, 911 of the second quadrilateral display segment set 96, the display segments 919, 920 of the fourth quadrilateral display segment set 98, and the eighth circle display segment 928 display the number "2" in the tens place, and the display segments 905, 907, 908 of the first quadrilateral display segment set 95, the display segments 914, 915 of the third quadrilateral display segment set 97, and the fifth circle display segment 925 are used to display the number "5" in the unit place.

From the abovementioned, this present invention provides a display device capable of automatically adjusting display orientation and the segment arrangement thereof, which enables the display device to display inner information of electronic product in any orientation correctly whatever the display device is positioned in any orientation such as horizontal or vertical.

Although the present invention has been explained in relation to its preferred embodiment, it is to be understood that many other possible modifications and variations can be made without departing from the scope of the invention as hereinafter claimed.

What is claimed is:

1. A display device for use in an electronic product, comprising:

a segment display device positioned on the electronic device, the segment display device including:

a first quadrilateral display segment set neighbored with the first display segment and the third display segment;

a second quadrilateral display segment set neighbored with the second display segment and the first quadrilateral display segment set; and a third quadrilateral display segment set neighbored with the fourth display segment and the first quadrilateral display segment set; display segments;

a position detection device positioned on the electronic product for generating a first status signal according to a horizontal position status of the electronic product, and generating a second status signal according to a vertical position status of the electronic product; and a decoding circuit connected to the segment display device and the position detection device for receiving a numerical signal to be displayed on the segment display device according to the first status signal and the second status signal, wherein, the numerical signal is displayed on the first and the second quadrilateral display segment sets according to the first status signal, and the numerical signal is displayed on the first and the third quadrilateral display segment sets according to the second status signal.

2. The display device as claimed in claim 1, wherein the segment display device is a segment light-emitting diode.

3. The display device as claimed in claim 1, wherein the segment display device is a vacuum fluorescent display.

4. The display device as claimed in claim 1, wherein the position detection device is a ball-rolling switch.

5. The display device as claimed in claim 1, wherein the position detection device is a mercury switch.

6. The display device as claimed in claim 1, wherein the position detection device is a tilt switch.

7. The display device as claimed in claim 1, wherein the decoding circuit is a processor for displaying the numerical signal on the segment display device according to the first status signal and the second status signal.

8. The display device as claimed in claim 1, wherein the segment display device further includes:

a first display segment;

a second display segment, wherein the first display segment and the second display segment are positioned vertically and aligned to each other;

a third display segment; and a fourth display segment, wherein the third display segment and the fourth display segment are positioned horizontally and aligned to each other;

wherein, the numerical signal is further displayed on the first and the second display segments according to the first status signal, and the numerical signal is further displayed on the third display segment and display segments according to the second status signal.

9. A display segment arrangement, suited for an electronic product, the display segment arrangement comprising:

a first display segment;

a second display segment, wherein the first display segment and the second display segment are positioned vertically and aligned to each other;

a third display segment;

a fourth display segment, wherein the third display segment and the fourth display segment are positioned horizontally and aligned to each other;

a first quadrilateral display segment set neighbored with the first display segment and the third display segment;

a second quadrilateral display segment set neighbored with the second display segment and the first quadrilateral display segment set; and a third quadrilateral display segment set neighbored with the fourth display segment and the first quadrilateral display segment set;

wherein each of the first quadrilateral display segment set, the second quadrilateral display segment set, and the third quadrilateral display segment set is composed of four display segments, when the electronic product is positioned horizontally, a numerical signal is displayed on the first display segment, the second display segment, the first quadrilateral display segment and the second quadrilateral display segment, and when the electronic product is positioned vertically, the numerical signal is displayed on the third display segment, the fourth display segment, the first quadrilateral display segment and the third quadrilateral display segment.

10. The display segment arrangement as claimed in claim 9, wherein the first display segment and the second display segment are used to display the number "1", and the first quadrilateral display segment set and the second quadrilateral display segment set are used to display the number "1" to "9".

11. The display segment arrangement as claimed in claim 8, wherein the third display segment and the fourth display segment are used to display the number "1", and the first quadrilateral display segment set and the third quadrilateral display segment set are used to display the number "0" to "9".

12. A display segment arrangement, suited for an electronic product, the display segment arrangement comprising:

a first quadrilateral display segment set;

a second quadrilateral display segment set neighbored with the first quadrilateral display segment set;

a third quadrilateral display segment set neighbored with the first quadrilateral display segment set;

a fourth quadrilateral display segment set neighbored with the second quadrilateral display segment set and the third quadrilateral display segment set;

a first display segment neighbored with the first quadrilateral display segment set;

a second display segment neighbored with the second quadrilateral display segment set, wherein the first display segment and the second display segment are positioned vertically and aligned to each other;

a third display segment neighbored with the second quadrilateral display segment set; and a fourth display segment neighbored with the fourth quadrilateral display segment set, wherein the third display segment and the fourth display segment are positioned horizontally and aligned with each other, wherein each of the first quadrilateral display segment set, the second quadrilateral display segment set, the third quadrilateral display segment set, and the fourth quadrilateral display segment set is composed of four display segments, when the electronic product is positioned horizontally, a numerical signal is displayed on the first display segment, the second display segment, and the first to the fourth quadrilateral display segment, and when the electronic product is positioned vertically, the numerical signal is displayed on the third display segment, the fourth display segment, and the first to the fourth quadrilateral display segment.

13. The display segment arrangement as claimed in claim 12, wherein the first quadrilateral display segment set is composed of fifth, sixth, seventh, and eighth display segments, wherein the fifth display segment neighbors with the first display segment, and other display segments arrange as a quadrilateral in clockwise; the second quadrilateral display segment set is composed of ninth, tenth, eleventh, and twelfth display segments, wherein the ninth display segment neighbors with the second display segment, and other display segments arrange as a quadrilateral in clockwise; the third quadrilateral display segment set is composed of thirteenth, fourteenth, fifteenth, and sixteenth display segments, wherein the thirteenth display segment neighbors with the first display segment, and other display segment arrange as a quadrilateral in clockwise; the fourth quadrilateral display segment set is composed of seventeenth, eighteenth, nineteenth, and twentieth display segments, wherein the seventeenth display segment neighbors with the second display segment, and other display segments arrange as a quadrilateral in clockwise; and wherein the width of the seventh, the eighth, the tenth, the eleventh, the thirteenth, the sixteenth, the seventeenth and the eighteenth display segments is half the width of other display segments.

14. The display segment arrangement as claimed in claim 12, wherein the first display segment and the second display segment are used to display the number "1", and the first quadrilateral display segment set and the second quadrilateral display segment set are used to display the number "0" to "9", and the third quadrilateral display segment set and the fourth quadrilateral display segment set are used to display the number "0" to "9".

15. The display segment arrangement antenna as claimed in claim 12, wherein the third display segment and the fourth display segment are used to display the number "1", and the second quadrilateral display segment set and the fourth quadrilateral display segment set are used to display the number "0" to "9", and the first quadrilateral display segment set and the fourth quadrilateral display segment set are used to display the number "0" to "9".

16. The display segment arrangement as claimed in claim 12, wherein the first quadrilateral display segment set is composed of fifth, sixth, seventh, and eighth display segments, wherein the fifth display segment neighbors with the first display segment, and other display segments arrange as a quadrilateral in clockwise; the second quadrilateral display segment set is composed of ninth, tenth, eleventh, and twelfth display segments, wherein the ninth display segment neighbors with the second display segment, and other display segments arrange as a quadrilateral in clockwise; the third quadrilateral display segment set is composed of thirteenth, fourteenth, fifteenth, and sixteenth display segments, wherein the thirteenth display segment neighbors with the first display segment, and other display segments arrange as a quadrilateral in clockwise; the fourth quadrilateral display segment set is composed of seventeenth, eighteenth, nineteenth, and twentieth display segments, wherein the seventeenth display segment neighbors with the second display segment, and other display segments arrange as a quadrilateral in clockwise; and wherein the display segment arrangement further comprises a first circle display segment located between the first display segment and the second display segment; a second circle display segment located between the third display segment and the fourth display segment; a third circle display segment located between the fifth display segment and the ninth display segment; a fourth circle display segment located between the seventh display segment and the eleventh display segment; a fifth circle display segment located between the sixth display segment and the fourteenth display segment; a sixth circle display segment located between the eighth display segment and the sixteenth display segment; a seventh circle display segment located between the tenth display segment and the eighteenth display segment; a eighth circle display segment located between the twelfth display segment and the twentieth display segment; a ninth circle display segment located between the thirteenth display segment and the seventeenth display segment; and a tenth circle display segment located between the fifteenth display segment and the nineteenth display segment.

17. The display segment arrangement as claimed in claim 16, wherein the first display segment, the second display segment, and the first circle display segment are used to display the number "1", and the first quadrilateral display segment set, the second quadrilateral display segment set, the third circle display segment, and the fourth circle display segment are used to display the number "0" to "9", and the third quadrilateral display segment set, the fourth quadrilateral display segment set, the ninth circle display segment, and the tenth display segment are used to display the number "0" to "9".

18. The display segment arrangement as claimed in claim 16, wherein the third display segment, the fourth display segment, and the second circle display segment are used to display the number "1"; the second quadrilateral display segment set, the fourth quadrilateral display segment set, the seventh circle display segment, and the eighth circle display segment are used to display the number "0" to "9"; the first quadrilateral display segment set, the fourth quadrilateral display segment set, the fifth circle display segment, and the sixth circle display segment are used to display the number "0" to "9".

* * * * *